US005727819A

United States Patent [19]

Grosskopf et al.

[11] Patent Number: 5,727,819

[45] Date of Patent: Mar. 17, 1998

[54] RESEALABLE LAMINATED PACKAGE LABEL HAVING TAMPER RESISTANT FEATURE

[75] Inventors: Glenn A. Grosskopf, Lake Zurich, Ill.; Carl W. Treleaven, Greensboro, N.C.

[73] Assignees: Pharmagraphics (Midwest), L.L.C.; Pharmagraphics (Southeast) L.L.C., both of Greensboro, N.C.

[21] Appl. No.: 657,682

[22] Filed: May 31, 1996

[51] Int. Cl.[6] ..... B42D 15/00

[52] U.S. Cl. ..... 283/81; 283/94

[58] Field of Search ..... 283/81, 80, 100, 283/101, 103, 105, 107, 109, 117, 94; 40/306, 310, 299; 428/40.1, 42.2, 42.3

[56] References Cited

U.S. PATENT DOCUMENTS

| | | | |
|---|---|---|---|
| 4,534,582 | 8/1985 | Howard | 283/81 |
| 4,592,572 | 6/1986 | Instance | 281/2 |
| 4,621,442 | 11/1986 | Mack | 40/2 R |
| 4,621,837 | 11/1986 | Mack | 283/105 |
| 4,711,686 | 12/1987 | Instance | 156/227 |
| 4,874,096 | 10/1989 | Tessera-Chiesa | 206/621 |
| 4,933,043 | 6/1990 | Instance | 156/248 |
| 4,955,640 | 9/1990 | Anderson | 281/2 |
| 4,991,878 | 2/1991 | Cowan et al. | 283/81 |
| 5,074,595 | 12/1991 | Hill et al. | 283/81 |
| 5,200,243 | 4/1993 | Van Veen | 428/40 |
| 5,207,458 | 5/1993 | Treichel et al. | 283/81 |
| 5,207,746 | 5/1993 | Jones | 283/81 |
| 5,234,735 | 8/1993 | Baker et al. | 428/40 |
| 5,262,214 | 11/1993 | Instance | 428/40 |
| 5,263,743 | 11/1993 | Jones | 283/81 |
| 5,389,415 | 2/1995 | Kaufmann | 283/81 X |
| 5,403,636 | 4/1995 | Crum | 428/40 |
| 5,588,239 | 12/1996 | Anderson | 283/81 X |

*Primary Examiner*—Willmon Fridie, Jr.

*Attorney, Agent, or Firm*—Rhodes, Coats & Bennett, L.L.P.

[57] ABSTRACT

A label including an informational leaflet having at least a bottom panel and a top panel, the top panel connected to the bottom panel. The label includes means for temporarily holding the top panel in overlying relationship with the bottom panel. A tamper tab extends outward beyond an edge of one of the panels and has a lower surface. An adhesive layer is disposed on the lower surface of the bottom panel and on the lower surface of the tamper tab, whereby the bottom panel may be secured to a first component of a package and the tamper tab may be secured to a second component such that relative displacement between the first and second components results in relative displacement of the bottom panel and the tamper tab.

Further, a label having a bottom panel, for example as just described, includes an adhesive layer disposed on the lower surface of the bottom panel. A laminate cover covers the bottom panel. The laminate cover is releasably adhered to at least a portion of the upper surface of the bottom panel. A leading edge of the laminate forms an angle of greater than 90° with respect to a prescribed direction of pull, whereby a portion of a pull force directed along the prescribed direction of pull is redirected at an angle to the prescribed direction to facilitate separation of the laminate cover from the upper surface of the bottom panel.

29 Claims, 5 Drawing Sheets

RESEALABLE LAMINATED PACKAGE LABEL HAVING TAMPER RESISTANT FEATURE

FIELD OF THE INVENTION

The present invention is directed to an extended text label, and, more particularly, to a resealable extended text label for pharmaceutical and like uses having a laminate cover and multiple panels including a base panel and selectively detachable additional panels, the label further including means for detecting tampering with an associated article.

BACKGROUND OF THE INVENTION

In the packaging of certain chemicals and pharmaceuticals, the manufacturer is often required or desires to provide a considerable amount of information concerning the chemical or pharmaceutical. In the case of pharmaceuticals, this is required by government regulations, however, the occasion may also arise, either separate from or in conjunction with government regulations, to provide the doctor, pharmacist or user with instructions on how the product should be used, what the product is, and safety precautions which should be followed in the use of the product. Sometimes the literature, which is generally in the form of folded leaflets, is placed within a box along with the container carrying the chemical or pharmaceutical (referred to as "inserts"). The placement of leaflets within the box is expensive and a cumbersome operation to perform. Also, it is difficult to insure by later inspection that the proper literature has been inserted in the proper package. Most all products are packaged in outer cartons and many are not compatible with inserts. Further, the use of folded cartons is under scrutiny by environmental groups, as involving excessive packaging. In an effort to meet this challenge, many companies are looking at ways to eliminate folding cartons that carry containers inside.

A different approach to solving this problem has developed over the last several years in which the folded literature is releasably attached to the face of the container (referred to as "outserts"), either directly to the container itself, or to a base label which, in turn, is secured to the container. The literature may then be removed by the customer. In such cases, the portion of the label remaining must carry both an "identification" of the product, for example, information such as trademark, manufacturer, etc., as well as certain "statutory information" (for example, lot number and expiration date).

Thus, in order to meet the objectives of such labeling techniques, certain criteria must be met. First of all, the portion of the label which remains after the folded literature product is removed must contain both the identification of the product, as well as the statutory information concerning the lot number, and expiration date. Further, after the literature leaflet is assembled or affixed to the base label, the indicated area for statutory information concerning lot number and expiration date must be accessible for stamping or priming by the pharmaceutical company and visible to the consumer in addition to the identification of the product. The folded leaflet portion remains affixed to the label portion until the customer (doctor, pharmacist, consumer) desires its removal. It is critical that the proper literature must be affixed to the proper base label. Finally, all of the above criteria must be accomplished in a manufacturing technique that insures quality and is cost-effective.

A further requirement for most pharmaceutical packaging is that means for detecting tampering with the package be provided. One accepted method of detecting tampering is the provision of a band or strip of perforated or easily tearable material extending between the two separable components of the package (typically a bottle and its lid or top). When the lid or top is partially or completely removed, the band or strip is tom, providing a permanent indication of the breach.

In many instances, it is desirable that the end user or potential end user be able to inspect the text on the interior panels of the multi-panel leaflet. However, most label designs do not allow the end user to open the label and inspect the interior panels without destroying the label. That is, typically, the end user must tear along a tear line or the like in order to access the interior panels. Once this has occurred, the label may not be returned to its original state, and, as a result, the perceived value of the goods to the end user is accordingly reduced.

In general, in labeling articles, it is desirable that the number and complexity of steps required to apply the labels to the articles be minimized. Further, it is desirable that the label design lend itself to application by automated means.

Thus, there exists a need for a multiple panel package label which allows for resealability, and provides easy access to the multiple panels thereof. There exists a need for a package label which includes means to indicate tampering with the associated article. There exists a need for a package label which combines the features of resealability and tamper resistance. There exists a need for a package label as described above which may be efficiently and cost effectively manufactured. Further, there exists a need for a package label as described above which may be efficiently and cost effectively applied to articles, and, particularly, by means of automated application equipment.

SUMMARY OF THE INVENTION

The present invention is directed to a multipanel informational label having an integral tamper evidence feature. The label is particularly well-suited for use with bottles, jars and the like in which pharmaceutical and similarly sensitive products are packaged. Removal or displacement of an associated lid causes the tamper evident feature to indicate a breach of the container. The present invention is further directed to a label having a resealable feature including a laminate cover releasably adhered to a further portion of the label. The laminate cover is adapted to facilitate separation of the laminate cover from the further portion. The label as so adapted is particularly well-suited for use on round containers. The present invention is further directed to a multipanel informational label having a tamper evident feature as described as well as a laminate cover adapted as described.

More particularly, the present invention is directed to a label for displaying information regarding a package, the package of the type having a first component and a second component displaceable with respect to the first component. The label includes a multipanel informational leaflet having at least a bottom panel and a top panel. The bottom panel has an upper surface and a lower surface. The top panel is connected to the bottom panel. The label further includes means for temporarily holding the top panel in overlying relationship with the bottom panel. A tamper tab extends outward beyond an edge of one of the panels and has a lower surface. An adhesive layer is disposed on the lower surface of the bottom panel and on the lower surface of the tamper tab, whereby the bottom panel may be secured to the first component of the package, and the tamper tab may be secured to the second component such that relative displacement between the first and second components results in relative displacement of the bottom panel and the tamper tab.

A tear line may be provided between the top panel and the bottom panel whereby the top panel may be detached from the bottom panel. At least one interior panel may be secured to one of the top panel and the bottom panel and overlying the bottom panel. The bottom panel may include a marginal portion extending beyond the top panel. A tear line may be formed in the tamper tab. A release liner may be releasably adhered to the adhesive layer.

Preferably, the means for holding the top panel in overlying relationship with the bottom panel is releasable and resealable. The means for holding the top panel in overlying relationship with the bottom panel may include a laminate cover overlying the top panel. In a preferred embodiment, the bottom panel includes a marginal portion extending beyond the top panel and the laminate cover includes a laminate margin releasably secured to the marginal portion. Preferably, the label further includes a varnish coating disposed on one of an upper surface of the marginal portion and a lower surface of the laminate margin, and a second adhesive layer disposed on the other of the upper surface of the marginal portion and the lower surface of the laminate margin adjacent the varnish coating, whereby the respective surfaces are releasably and resealably adhered to one another. Preferably, a laminate tear line is formed in the laminate cover whereby a portion of the laminate cover may be detached from the label.

In a label as described above, a pull tab may be provided extending beyond and integral with the laminate margin, whereby the laminate margin may be separated from the marginal portion by pulling the pull tab away from the package when the label is affixed thereto. Preferably, the pall tab includes a laminate pull tab forming a part of the laminate cover and extending beyond the laminate margin. Further, the pull tab preferably includes a base pull tab forming a part of the bottom panel and extending beyond the marginal portion, the base pull tab underlying the laminate pull tab. The laminate pull tab may be secured to the base pull tab by a laminate adhesive.

In one embodiment, the laminate cover includes a laminate tamper tab covering the tamper tab and is secured thereto by a laminate adhesive. Preferably, a score line is provided in the laminate cover adjacent to the laminate tamper tab whereby, when the laminate cover is pulled away from the remainder of the label, the laminate tamper tab remains with the remainder of the label. Alternatively, the tamper tab may be exposed.

In embodiments as described above including a laminate cover, the laminate cover is preferably releasably secured to the upper surface of the bottom panel and has a leading edge. The leading edge forms an angle of greater than 90° with respect to a prescribed direction of pull, whereby a portion of a pull force directed along the prescribed direction of pull is redirected at an angle to the prescribed direction to facilitate separation of the laminate cover from the upper surface of the bottom panel. Preferably, the angle is from 110° to 155°; more preferably, the angle is from 110° to 135°.

The present invention is also directed to a label for displaying information regarding a package, the label including a multipanel informational leaflet having at least a bottom panel and a top panel, the bottom panel having an upper surface and a lower surface, the top panel overlying the upper surface of the bottom panel and connected to the bottom panel. A laminate cover overlies the top and bottom panels. At least a portion of the laminate cover is releasably adhered to one of the bottom panel and the top panel. The laminate cover has a leading edge. The leading edge forms an angle of greater than 90° with respect to a prescribed direction of pull, whereby a portion of a pull force directed along the prescribed direction of pull is redirected at an angle to the prescribed direction to facilitate separation of the laminate cover from one of the panels. Preferably, the angle is from 110° to 155°; more preferably, the angle is from 110° to 135°. Further, the label as just described may include one or more of the features as discussed with regard to the first described label.

The present invention is further directed to a label for displaying information regarding a package, the label including a bottom panel having an upper surface and a lower surface. An adhesive layer is disposed on the lower surface of the bottom panel. A laminate cover covers the bottom panel. The laminate cover is releasably adhered to at least a portion of the upper surface of the bottom panel. The laminate cover has a leading edge. The leading edge forms an angle of greater than 90° with respect to a prescribed direction of pull, whereby a portion of a pull force directed along the prescribed direction of pull is redirected at an angle to the prescribed direction to facilitate separation of the laminate cover from the upper surface of the bottom panel. Further, the label as just described may include one or more of the features as discussed with regard to the first described label.

An object of the present invention is to provide a multiple panel package label which is resealable.

An object of the present invention is to provide a multiple panel package label having means to indicate tampering with an associated article.

A further object of the present invention is to provide an integral multiple panel package label which allows for resealability, and also includes a tamper resistant feature.

A further object of the present invention is to provide a multiple panel label which provides easy access to the information on the multiple panels.

An object of the present invention is to provide a label in which the printing components thereof may be formed from a unitary construction, thereby eliminating the risk of mismatching such components.

An object of the present invention is to provide a label which provides both extended text and a tamper resistant feature which may be conveniently and cost effectively applied to an associated article. Further, it is an object of the present invention to provide such a label which may be conveniently and cost effectively applied to the associated article using automated application equipment.

Yet another object of the present invention is to provide a package label as described above which may be efficiently and cost effectively manufactured.

The preceding and further objects of the present invention will be appreciated by those of ordinary skill in the art from a reading of the figures and the Detailed Description of the Preferred Embodiment which follow, such description being merely illustrative of the present invention.

DETAILED DESCRIPTION OF THE PREFERRED EMBODIMENTS

Figure 1:
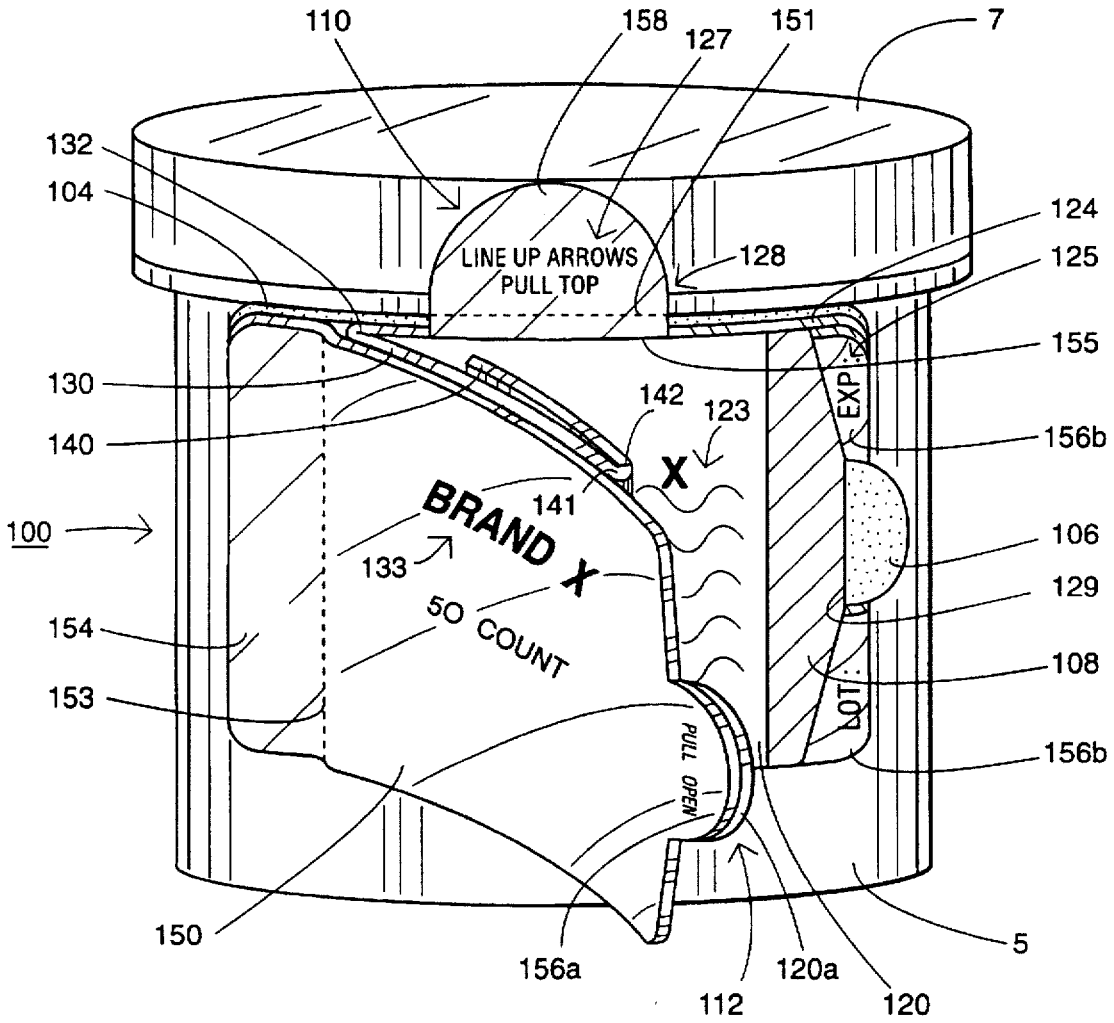
FIG. 1 is a perspective view of a label according to a first embodiment of the present invention disposed on a container, the label in an open position.
Figure 2:
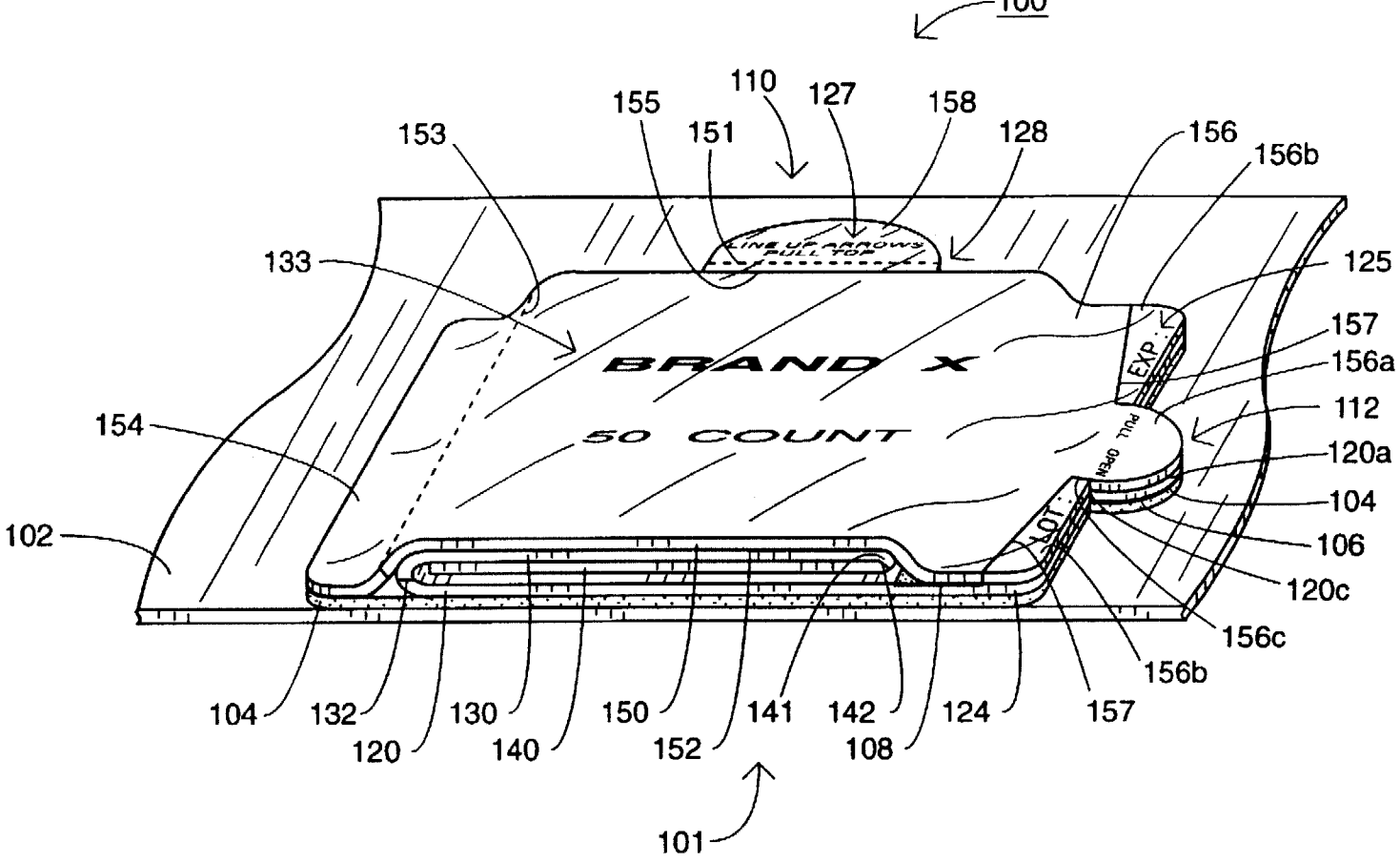
FIG. 2 is a perspective view of the label according to the first embodiment disposed on a release liner, the label in a stored or closed position.

With reference to FIGS. 1 and 2, a label according to a first embodiment of the present invention, generally denoted by the numeral 100, is shown therein. Label 100 includes leaflet 101 and laminate cover 150. Initially, label 100 is releasably secured to release liner 102 (FIG. 2) by adhesive layer 104. Adhesive layer 104 remains with label 100 when it is removed from release liner 102 and serves to secure label 100 to a container 5 having a removable top 7 (FIG. 1). It will be appreciated that the container may be, for example, a bottle, a jar, a box having a removable lid or a flap which may be swung away from the remainder of the box, or any other type of packaging wherein two components are relatively separable to gain access to the contents thereof.

Label 100 includes tamper indicator tab 110 and pull tab 112, the construction of each being discussed in more detail below. Label 100 is mountable on container 5 such that tamper tab 110 is secured to removable top 7 while the remainder of the label is secured to the remainder of the container such that, when top 7 is displaced with respect to container 5, tamper tab 110 is torn. Further, label 100 may be transitioned from the closed position as shown in FIG. 2 to the open position as shown in FIG. 1 by pulling pull tab 112 away from the remainder of the label causing laminate cover 150 to release from the remainder of the label. Label 100 is resealable so that it may be transitioned back from the open position of FIG. 1 to the closed position of FIG. 2 by relaminating the laminate cover 150 to the remainder of the label.

Leaflet 101 includes bottom panel 120, top panel 130, and one or more interior panels 140. Tear line 132 is provided in top panel 130 adjacent the fold between top panel 130 and bottom panel 120. Tear line 142 is provided in interior panel 140 adjacent the fold between top panel 130 and interior panel 140 which are joined at fold 141. Suitable materials for forming leaflets 101 include 60 pound coated two-side paper stock.

Bottom panel 120 has indicia 123 and 125 printed on the upper surface thereof and is coated on its rear surface by adhesive 104, preferably a pressure sensitive adhesive. Bottom panel 120 further includes marginal portion 124 extending beyond the fold between top panel 130 and interior panel 140. As discussed in more detail below, a portion of the upper surface of marginal portion 124 is coated with varnish 108. Suitable varnishes include product number L075 available from Paragon Inks, Ltd. of Boxburn, Scotland. Tab 128 extends from the top edge of bottom panel 120 and forms a part of tamper tab 110. Indicia 127 is disposed on the upper surface of tab 128 and the lower surface of tab 128 is coated by adhesive 104. Tab **120*a* extends from the right, transverse edge of marginal portion 124 of bottom panel 120 and forms a part of pull tab 112. Tab 120*a* is defined by score line 129, cut lines 120*c*, and the free, curved right edge which define a semi-circle therein. The construction of tab 120*a* will be better understood from the description of pull tab 112** generally, below.

Top panel 130 includes indicia 133 disposed on the upper surface thereof as well as indicia 134 (see FIG. 4 wherein a leaflet blank is shown) disposed on the lower surface thereof. Interior panel 140 similarly may include indicia 143, 144 (see FIGS. 4 and 5 wherein top and bottom views, respectively, of a leaflet blank are shown) on opposed sides thereof. Preferably, indicia 123 of the bottom panel includes indicia substantially identical to indicia 133 of the top panel. The various indicia on panels 120, 130, 140 may include, for example, product names, warnings, directions, advertisements, coupons, and related graphics.

Laminate cover 150 overlies leaflet 101 and is secured thereto by laminate adhesive 152. Laminate portion 154 is releasably adhered to release liner 102. Laminate portion 156 is permanently adhered to portions of the upper surface of marginal portion 124 and releasably adhered to other portions of the upper surface of marginal portion 124, as discussed in more detail below. Tab 158 is permanently secured to the upper surface of tab 128 by laminate adhesive 152 and forms a part of tamper tab 110. Tear line 153 is formed adjacent laminate portion 154. Score lines 157 and cut lines **156*c* are formed adjacent marginal extended flap 124. Tear line 151 is formed in tab 158. Optionally, suitable indicia (not shown) may be printed on the upper surface of laminate portion 154. Score line 155 is formed in laminate cover 150 adjacent tab 158. Laminate cover 150** is preferably formed from polypropylene. Suitable laminate materials include, for example, 2 mil polypropylene product number 04324 available from Madico Incorporated of Woburn, Mass.

Turning to pull tab 112 in greater detail, pull tab 112 includes laminate tab **156*a* and bottom panel tab 120*a*. The adhesive 104 adjacent the undersurface of tab 120*a* is coated with an adhesive deadener 106, for example, product number FM 1512 available from K & W Printing, Inc. of Franklin Park, Ill. In this manner, pull tab 112 will not adhere to this portion of the adhesive so that the adhesive remains with the release liner when label 100 is removed from the release liner. Accordingly, as no adhesive is present on the underside of tab 120*a*, tab 120*a* will not adhere to the article to which label 100 is affixed. Alternatively, adhesive 104 may not be provided on the release liner adjacent the undersurface of tab 128, in which case adhesive deadener 106** is not needed.

As noted above, cut lines 129 and **120*c* together define tab 120*a* which is thereby segmented from the remainder of bottom panel 120. Laminate tab 156*a* which is secured to the upper surface of tab 120*a* by laminate adhesive 152 is continuous over score line 129, i.e., there is no corresponding score line formed in laminate cover 150. Cut lines 156*c* formed in laminate cover 150 overlie and are co-extensive with cut lines 120*c* of bottom panel 120. Score lines 157 are formed through the laminate cover. Bottom panel 120 includes no score lines corresponding to score lines 157**.

Score lines 157 and 156c along with the edges of the label form upper and lower portions 156b. No varnish 108 is disposed on the portions of the upper surface of marginal portion 124 adjacent laminate portions 156b so that portions 156b are permanently adhered to bottom panel 120 by laminate adhesive 152. Likewise, no varnish is disposed between laminate tab 156a and the upper surface of bottom panel tab 120a. The remaining upper surface of marginal portion 124 is coated with varnish 108 so that laminate portion 156 to the left of score lines 157 and score line 129 is releasably and resealably adhered to the varnish coated upper surface of marginal portion 124. Suitable indicia 125 may be printed on the upper surface of marginal portion 124 beneath portions 156b.

Figure 8:
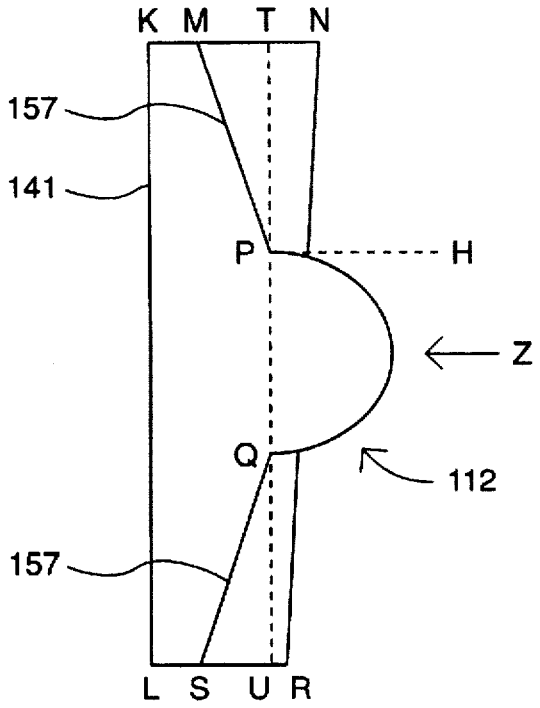
FIG. 8 is a fragmentary, schematic view showing the relationship between the lead edges of the laminate cover and a prescribed direction of pull for opening the labels of the first and second embodiments.

Turning to FIG. 8, the preferred angles of score lines 157 (lines MP and SQ) will be discussed with reference thereto. Direction arrow Z represents a prescribed ideal direction of pull for separating portion 156 of laminate cover 150 from the portion of marginal portion 124 coated with varnish 108. In the present case, direction Z is perpendicular to the fold 141 (line KL) between the top and bottom panels, the end edge (line PQ) of pull tab 112, and the top and bottom edges of the label (line KN and line LR, respectively). The leading edge (line NR) of the label is asymmetric to better accommodate a container which tapers downwardly, thereby creating an angle NRL greater than 90°. Imaginary line PH is parallel to direction Z. Preferably, angle MPH is in the range of 110° to 155°. More preferably, angle MPH is in the range of 110° to 135°. Angles MPH greater than 135° typically unduly add to the overall length of the label while angles less than 110° provide minimal benefit in facilitating separation of the laminate cover from the bottom panel.

The configuration of FIG. 8 may be modified depending on the desired shape of certain components of the label, the shape of the intended container, and the intended orientation of the label with respect to the container. For example, neither fold 141 (line KL) nor the end edge (line PQ) of pull tab 112 need be perpendicular to direction Z. The leading edge of the label (line NR) may take any shape and may even be coextensive with line TU or inwardly angled into the areas defined within MPT and SUQ. Typically, the preferred direction Z will be either coplanar with the circumference of the container (e.g., the user pulls from side to side, the label mounted on a vertically oriented cylindrical container) or perpendicular to the circumference of the container (e.g., the user pulls upwardly or downwardly, the label again mounted on a vertically oriented cylindrical container). Where the direction of pull Z is not as described above, the preferred ranges of the angles of score lines 157 with respect to direction Z may be altered, and, moreover, such preferred angles may be different for each of the upper and lower score lines 157.

The distance between K and M and between L and S is preferably at least ⅛ inch. Because of the thickness associated with panels 130 and 140 (which are joined at fold line 141 represented as line KL), the ⅛ inch or greater spacing is needed to ensure that laminate cover 150 is properly adhered to the varnish coated upper surface of marginal portion 124. The distance between K and N and between L and R (N and R representing the most extreme corners of the label) should be at least ⅜ inch.

In use, label 100 is affixed to an associated container 5 by means of adhesive 104 with tamper tab 110 affixed to top 7. When the end user wishes to open the label, he or she does so by grabbing pull tab 112 and pulling it away from the container. Because of the provision of adhesive deadener 106, pull tab 112 consisting of laminate tab 156a and tab 120a easily pulls away from the container. As pull tab 112 is pulled upwardly, laminate portion 156 is delaminated from the varnish coated upper surface of marginal portion 124. Notably, tab 120a separates from the remainder of bottom panel 120 because of the provision of score lines 129 and 120c. Likewise, laminate tab 156a and the remainder of laminate portion 156 separate from laminate portions 156b due to the provision of score lines 157 and 156c. Delamination of the laminate cover from the bottom panel is facilitated by the angles of score lines 157 which cause a significant portion of the initial peeling force to be directed along a tangent to the circumference of the bottle. As laminate cover 150 is lifted away from the container, it separates from laminate tab 158 due to the provision of cut line 155.

Once label 100 has been opened as described above, the user has several options. First, the user may return the label to the closed configuration of FIG. 2 by relaminating laminate portion 156 to marginal portion 124. Further, the user may remove interior panel 140 by tearing along tear line 142 and thereafter reclose the label. Alternatively, the user may remove laminate cover 150, top panel 130, and interior panel 140 by tearing along tear lines 153 and 132. It will be appreciated that if the latter option is chosen, laminate margin 154 (which may include indicia thereon) as well as bottom panel 120 having indicia 123, 125 will remain with the container. Notably, tamper tab 110, still untorn, will remain with the container as well.

Tamper tab 110 functions in much the same way as conventional tamper tabs of similar design. As discussed above, base panel 120 of which tab 128 forms a part is permanently adhered to container 5 while tab 128 is permanently adhered to container top 7. Relative displacement of top 7 and container 5 causes relative displacement of bottom panel 120 and tab 128, resulting in shearing along leaflet perforations 121 (see FIGS. 4 and 5) and laminate perforations 151.

A primary benefit of label 100 is that a multi-panel label and a tamper evidence feature may be applied in a single operation, namely, the mere application of label 100 to the container and top. As a result, the number of steps required as compared to conventional labeling methods wherein separate tamper evident features and textual labels are applied is halved. Further, label 100 allows for the opening and closing of the label for inspection of the text therein without affecting the tamper evidence feature of the label. Additionally, by providing a unitary label having a tamper evidence feature, the risk of mismatching these components or of having one of these components removed and replaced (in particular, the tamper evidence feature) is reduced or eliminated.

Figure 3:
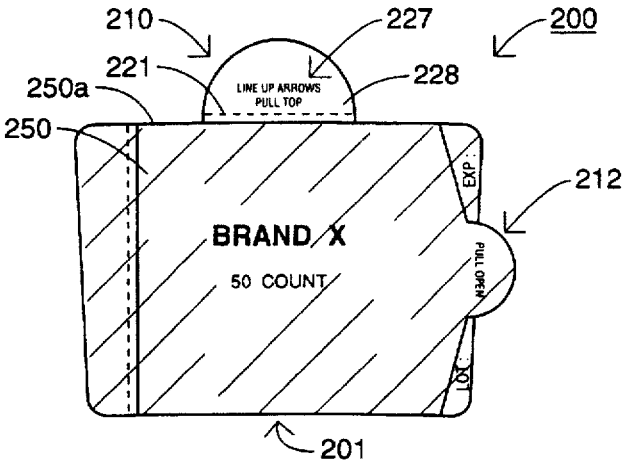
FIG. 3 is a top plan view of a label according to a second embodiment of the present invention, the label in a closed or stored position.

A label 200 according to a second embodiment of the present invention is shown in FIG. 3. Label 200 is substantially similar to label 100. In particular, leaflet 201 and pull tab 212 correspond to leaflet 101 and pull tab 112 of the first embodiment. Label 200 differs from label 100 in that no component corresponding to laminate tab 158 (or tear line 151 therein) is provided. Rather, laminate cover 250 terminates at upper edge 250a. Tamper tab 228, perforation 221, and indicia 227 correspond to elements 128, 121 (see FIGS. 4 and 5), and 127 of label 100. It will be appreciated that label 200 functions and may be utilized in the same manner as label 100.

Figure 4:
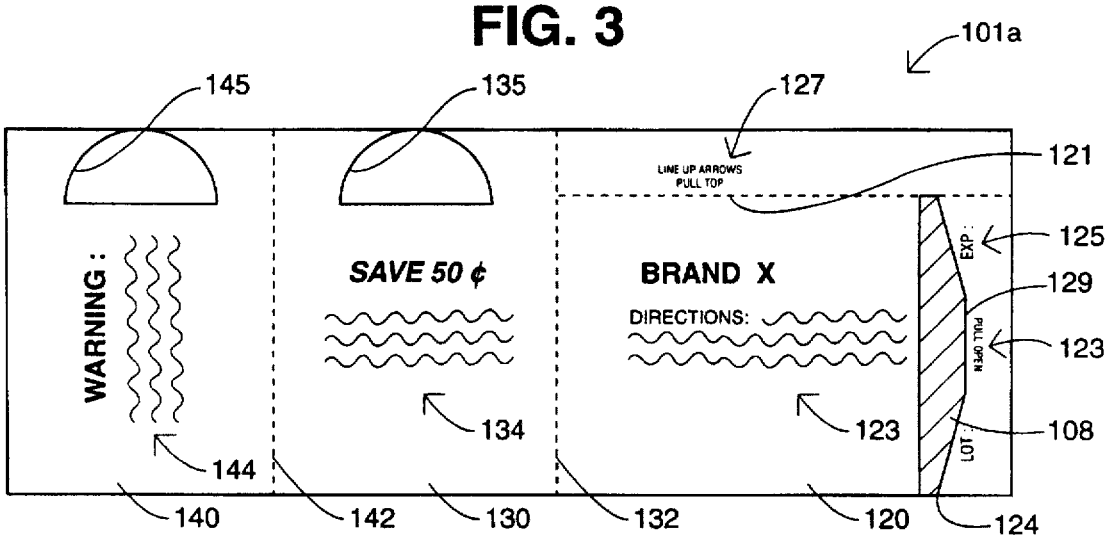
FIG. 4 is a top plan view of a label blank for forming a leaflet for incorporation in either of the labels according to the first and second embodiments.
Figure 5:
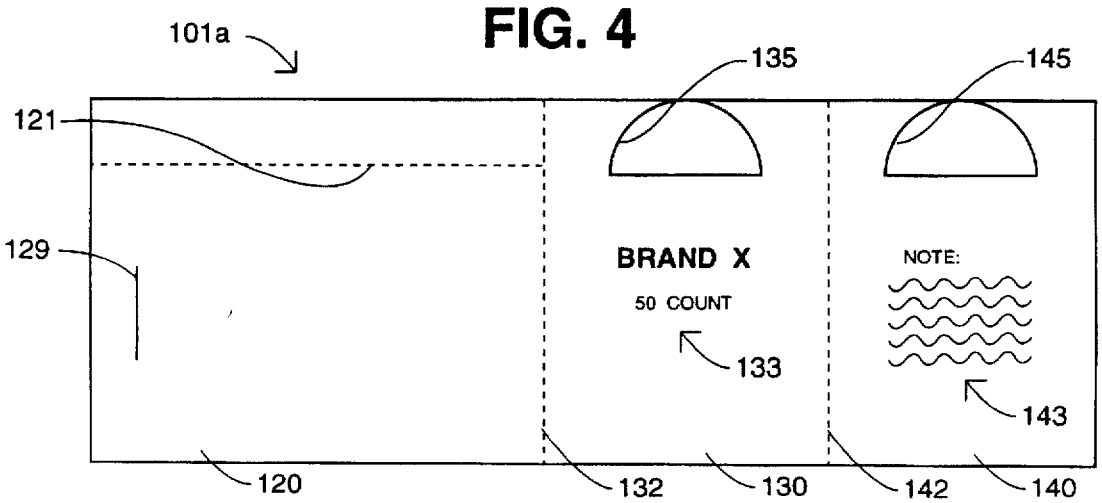
FIG. 5 is a bottom plan view of the leaflet blank of FIG. 4.
Figure 6:
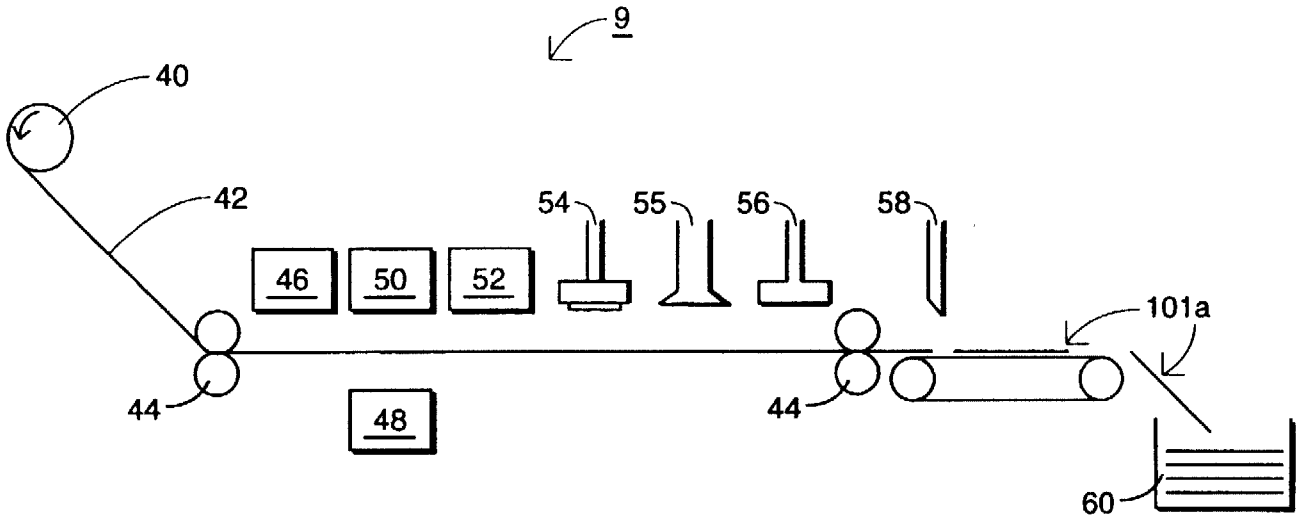
FIG. 6 is schematic diagram of an apparatus for forming the label blank of FIGS. 4 and 5.

Labels 100 are first formed by forming leaflet blanks 101a (see FIGS. 3 and 4), which are folded into leaflet constructions 101b (see FIG. 7), which are in turn applied to an adhesive web, covered with a laminate web and cut to size. With reference to FIG. 6, an apparatus for forming leaflet blanks 101*a* (as shown in FIGS. 4 and 5) is shown therein. First, a suitable stock web 42 is supplied from unwind station 40. Web 42 may be, for example, a paper or film stock. Suitable webs include Valeton film face stock as described above. Web 42 is drawn through apparatus or press 9 by guide or draw rollers 44. Print stations 46 and 48 print the desired indicia 123, 125, 127, 133, 134, 143, and 144 on the upper and lower opposed surfaces of web 42. Varnish applying station 50 applies strips of varnish 108 across web 42 at spaced locations along the length of the web. Varnish strips 108 are cured at curing station 52, if necessary. Holes 135 and 145 are cut in locations corresponding to panels 130 and 140, respectively, by die cutting station 54. The loose waste material defined within the cut lines is removed by vacuum station 55. Tear lines 132, 142 and score line 129 are formed at die cut station 56. Perforation 121 may also be formed at die cut station 56. Alternatively, perforation 121 may be formed after the leaflet has been applied to the release liner, as discussed below. Web 42 is then sheeted by cutting station 58, thereby forming leaflet blanks 101*a*. Leaflet blanks 101*a* are shown in FIG. 4 (top view) and FIG. 5 (bottom view). Leaflet blanks 101*a* may then be collected in magazine 60.

Leaflet blanks 101*a* thus formed are subsequently folded to form leaflet constructions 101*b*. End panel(s) 140 is (are) folded up and onto top panel 130. Panels 130 and 140 are then folded up and onto bottom panel 120, forming a leaflet construction 101*b*. Leaflet construction 101*b* differs from leaflet 101 of finished label 100 in that it has not yet been cut to define tabs 120*a* and 128. Notably, indicia 127 is exposed through superimposed holes 135 and 145. Holes 135 and 145 are preferably somewhat larger (on the order of 0.0625 inch) than the desired tab 128.

Figure 7:
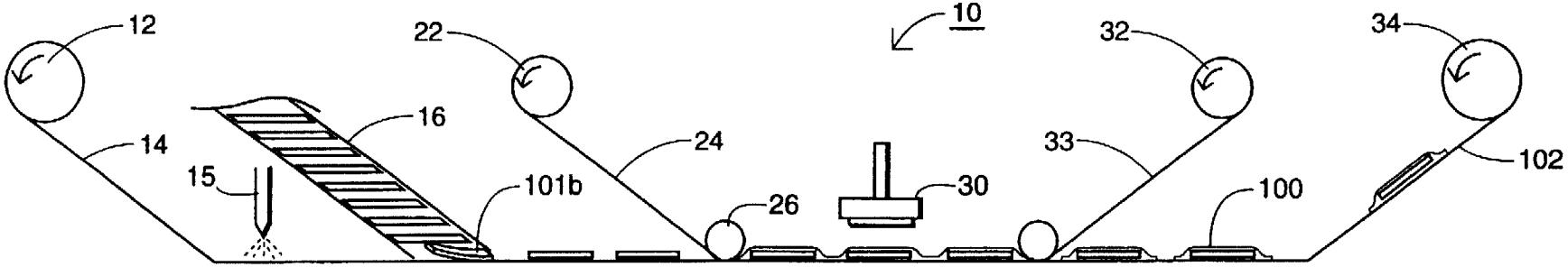
FIG. 7 is a schematic diagram of an apparatus for forming labels according to either of the first and second embodiments.

With reference to FIG. 7, an apparatus 10 for forming labels 100 from leaflet constructions 101*b* is shown therein. First, a suitable web 14 is supplied from unwind station 12. Web 14 may be a transfer tape or laminating adhesive such as 3M Product No. 9447, 1 mil High Tenacity Tape with 320 Adhesive. The transfer tape preferably includes release liner 102 having an adhesive layer of pressure sensitive adhesive on the upper surface thereof. Transfer tapes having a second release liner layer located on the adhesive layer may also be used. Alternatively, web 14 may be a release liner to which pressure sensitive adhesive is applied to the upper surface thereof by an adhesive applicator (not shown), for example, a slot coater as available from Nordson Corporation, including just prior to application of each leaflet construction 101*b*. Alternatively, the adhesive may be applied to the lower surfaces of the leaflet constructions 101*b*.

Alternatively, web 14 may be a double coated tape consisting of release liner 102, a first adhesive layer coating the upper surface of the release liner, a carrier preferably formed from a polymeric material such as polypropylene substrate overlying the first adhesive layer, and a second adhesive layer overlying the carrier. Double coated tape as described may be formed by applying a pressure sensitive adhesive coating to the upper surface of a self adhesive polypropylene substrate disposed on a release liner, such as 3M Scotch Brand Tape Product No. 7214FL 2 mil polypropylene. Double coated tapes having a second release liner layer located on the second adhesive layer may also be used. Double coated tapes having carriers formed from polyester, polystyrene, polyethylene or other polyolefins may be used as well. A suitable product having a polyester carrier is Flexcon Flexmark Product No. DFM-100-Clear V-23/70 D/FK. Notably, if labels are formed form double coated tape as just described, the resulting labels would not appear as described with regard to the first and second embodiments, but rather would include an additional adhesive layer and a carrier interposed between the leaflet and the release liner.

As a further alternative, web 14 may be a self adhesive stock web preferably consisting of a web of face stock releasably adhered to a release liner by means of a pressure sensitive adhesive coating. The self adhesive stock web may be, for example, high gloss paper with S246 adhesive available from Fasson. If a self adhesive stock web is used, an adhesive applicator would be provided to apply adhesive to the upper surface of the self adhesive stock web or to the lower surface of the bottom panels prior to application of the leaflet constructions 101*b* to the web. Notably, if labels are formed using a self adhesive base stock web as just described, the resulting labels will not appear as described in the first and second embodiments, but rather would also include a layer of pressure sensitive adhesive and base stock interposed between the release liner or container and the bottom panel.

Prior to application of leaflet constructions 101*b* to web 14, adhesive deadener 106 is applied by deadener applicator 15 to the exposed adhesive of web 14 in locations corresponding to pull tab 112. Alternatively, if web 14 is formed by applying adhesive to a release liner or web of face stock, the adhesive may be selectively applied so that no adhesive is disposed corresponding to pull tab 112.

Leaflet constructions 101*b* are applied to web 14 by leaflet application station 16. Thereafter, self adhesive laminate web 24 is supplied by unwind station 22 and adhered by nip roller 26 and the adhesive thereof over leaflet constructions 101*b* and web 14. Die cutter station 30 cuts through laminate web 24 forming laminate covers 150 including tabs 158 and 156*a*. Further, leaflet constructions 101*b* are cut to form leaflets 101 having tabs 128 and 120*a*. Notably, the die cut forming the upper edges of the leaflet and the laminate cover will sever the portions of panels 130 and 140 adjacent holes 135 and 145, respectively, as well as the portion of bottom panel 120 above the leaflet upper edge and not defined in tab 128. Each of tear or score lines 120*c*, 151, 153, 155, 156*c*, and 157 may be formed by die cut station 30 or a further die cut station. Moreover, tear line 121 may be formed in leaflet 101 after application to the web.

Optionally, desired indicia may be printed on the upper surface of the laminate cover, for example, on portion 154, by a printing station (not shown) downstream of the application of the laminate web to web 14.

Waste matrix 33 including the portions of laminate web 24 outside laminate covers 150 and the underlying adhesive and leaflet material (including the material adjacent holes 135, 145 and tab 128) are removed by winding station 32. The resulting labels 100 carried on release liner 102 may then be collected on a roll by winding station 34 or sheeted and stacked.

Label 200 may be formed using the same materials as discussed above with respect to label 100. With reference to FIG. 6, in forming the leaflets 201 of labels 200, varnish 108 is also applied by station 50 on tab 228. The laminate web is die cut such that, when the laminate waste matrix is removed, the portion of the laminate web overlying tab 228 is removed therewith. The varnish coating tab 228 allows the laminate web to release without destroying the tab. Suitable modifications to the above described apparatus and method for making labels 100 in order to form labels 200 will be apparent to those of ordinary skill in the art upon a reading of the foregoing description.

Laminate covers 150, 250 allow the respective labels to be formed from "multiple up" books. Once the laminate web is applied to the multiple up book, the laminate web and each multiple up book are cut into multiple labels which extend across the adhesive web. Once the multiple up book is die cut, waste sections defined between the cut lines forming the respective labels must be removed along with the other waste matrix materials. Because the self adhesive laminate web is provided, the waste sections will be removed along with the other waste matrix without further provision because of the integrity and continuity of the laminate material. The adhesive web may or may not thereafter be slit into individual webs.

It will be appreciated that labels according to the present invention may be formed such that the portions of the tamper evident tab and the pull tab forming a part of the leaflet extend from the top panel or an interior panel rather than the bottom panel. Further, the portion forming a part of the tamper evident tab and the portion forming a part of the pull tab need not extend from the same panel. However, the provision of a tamper evident tab extending from the top or an interior panel will compromise the ability of the label to be opened and closed to inspect the indicia therein without destroying the tamper evident feature.

It will be appreciated that the labels of the present invention may be varied in other ways as well. For example, a label may be formed having two or more superimposed panels with adhesive on the lower surface of the bottom panel, and a tamper tab extending from an edge of one or both of the panels, but wherein no laminate cover is provided. The panels may be held in a closed position until needed by a strip or dot of adhesive between the panels. Such an embodiment would provide the benefits of a multi-panel, unitary label having a tamper resistant feature. A label having either or both of the tamper tab and releasability features may be formed having a bottom panel and a laminate cover with no top or interior panels provided.

As a further alternative, the labels of the present invention may be formed with a tear strip along the edge opposite the pull tab in place of the tear lines described above. More particularly, a pair of substantially parallel transverse tear lines are formed in the laminate cover each overlying and coextensive with a respective one of the tear lines in the top panel.

While a preferred embodiment of the present invention has been described, it will be appreciated by those of skill in the art that certain modifications may be made without departing from the scope of the present invention. All such modifications are intended to come within the scope of the claims which follow.

What is claimed is:

1. A label for displaying information regarding a package, the package of the type having a first component and a second component displaceable with respect to the first component, said label comprising:

a) a multipanel informational leaflet having at least a bottom panel and a top panel, said bottom panel having an upper surface and a lower surface, said top panel connected to said bottom panel;

b) means for temporarily holding said top panel in overlying relationship with said bottom panel;

c) a tamper tab extending outward beyond an edge of one of said panels and having a lower surface; and e) an adhesive layer disposed on said lower surface of said bottom panel and on said lower surface of said tamper tab, whereby said bottom panel may be secured to the first component of the package and said tamper tab may be secured to the second component such that relative displacement between the first and second components results in relative displacement of said bottom panel and said tamper tab.

2. The label of claim 1 including a tear line between said top panel and said bottom panel, whereby said top panel may be detached from said bottom panel.

3. The label of claim 1 further including at least one interior panel secured to one of said top panel and said bottom panel and overlying said bottom panel.

4. The label of claim 1 wherein said bottom panel includes a marginal portion extending beyond said top panel.

5. The label of claim 1 including a tear line formed in said tamper tab.

6. The label of claim 1 including a release liner releasably adhered to said adhesive layer.

7. The label of claim 1 wherein said means for holding said top panel in overlying relationship with said bottom panel is releasable and resealable.

8. The label of claim 1 wherein said means for holding said top panel in overlying relationship with said bottom panel includes a laminate cover overlying said top panel.

9. The label of claim 8 wherein said bottom panel includes a marginal portion extending beyond said top panel, said laminate cover including a laminate margin releasably secured to said marginal portion.

10. The label of claim 9 further including a varnish coating disposed on one of an upper surface of said marginal portion and a lower surface of said laminate margin, and a second adhesive layer disposed on the other of said upper surface of said marginal portion and said lower surface of said laminate margin adjacent said varnish coating, whereby said respective surfaces are releasably and resealably adhered to one another.

11. The label of claim 9 further including a pull tab extending beyond and integral with said laminate margin, whereby said laminate margin may be separated from said marginal portion by pulling said pull tab away from the package when said label is affixed thereto.

12. The label of claim 11 wherein said pull tab includes a laminate pull tab forming a part of said laminate cover and extending beyond said laminate margin.

13. The label of claim 12 wherein said pull tab further includes a base pull tab forming a part of said bottom panel and extending beyond said marginal portion, said base pull tab underlying said laminate pull tab.

14. The label of claim 13 wherein said laminate pull tab is secured to said base pull tab by a laminate adhesive.

15. The label of claim 8 including a laminate tear line formed in said laminate cover, whereby a portion of said laminate cover may be detached from said label.

16. The label of claim 8 wherein said laminate cover includes a laminate tamper tab covering said tamper tab and secured thereto by a laminate adhesive.

17. The label of claim 16 including a score line in said laminate cover adjacent said laminate tamper tab whereby, when said laminate cover is pulled away from the remainder of said label, said laminate tamper tab remains with the remainder of said label.

18. The label of claim 8 wherein said tamper tab is exposed.

19. The label of claim 8 wherein said laminate cover is releasably secured to said upper surface of said bottom panel, said laminate cover having a leading edge, said leading edge forming an angle of greater than 90° with respect to a prescribed direction of pull, whereby a portion of a pull force directed along said prescribed direction of pull is redirected at an angle to said prescribed direction to facilitate separation of said laminate cover from said upper surface of said bottom panel.

20. The label of claim 19 wherein said angle is from 110° to 135°.

21. The label of claim 19 wherein said angle is from 110° to 155°.

22. A label for displaying information regarding a package, the package of the type having a first component and a second component displaceable with respect to the first component, said label comprising:

a) a multipanel informational leaflet including:

i) at least a bottom panel and a top panel, said top panel connected to said bottom panel;

ii) said bottom panel having an upper surface and a lower surface and including a marginal portion extending beyond said top panel;

iii) a tear line between said top panel and said bottom panel whereby said top panel may be detached from said bottom panel;

b) a laminate cover overlying said top panel for temporarily holding said top panel in overlying relationship with said bottom panel, said laminate cover including a laminate margin releasably secured to said marginal portion;

c) a laminate tear line formed in said laminate cover whereby a portion of said laminate cover may be detached from said label;

d) a varnish coating disposed on one of an upper surface of said marginal portion and a lower surface of said laminate margin, and a second adhesive layer disposed on the other of said upper surface of said marginal portion and said lower surface of said laminate margin adjacent said varnish coating, whereby said respective surfaces are releasably and resealably adhered to one another;

e) said laminate cover having a leading edge, said leading edge forming an angle of greater than 90° with respect to a prescribed direction of pull, whereby a portion of a pull force directed along said prescribed direction of pull is redirected at an angle to said prescribed direction to facilitate separation of said laminate cover from said upper surface of said bottom panel;

f) a tamper tab extending outward beyond an edge of one of said panels and having a lower surface;

g) a tear line formed in said tamper tab; and h) an adhesive layer disposed on said lower surface of said bottom panel and on said lower surface of said tamper tab, whereby said bottom panel may be secured to the first component of the package and said tamper tab may be secured to the second component such that relative displacement between the first and second components results in relative displacement of said bottom panel and said tamper tab.

23. The label of claim 22 further including at least one interior panel secured to one of said top panel and said bottom panel and overlying said bottom panel.

24. The label of claim 22 further including a pull tab extending beyond and integral with said laminate margin, whereby said laminate margin may be separated from said marginal portion by pulling said pull tab away from the package when said label is affixed thereto.

25. The label of claim 24 wherein said pull tab includes a laminate pull tab forming a part of said laminate cover and extending beyond said laminate margin, and a base pull tab forming a part of said bottom panel and extending beyond said marginal portion, said base pull tab underlying said laminate pull tab, and wherein said laminate pull tab is secured to said base pull tab by a laminate adhesive.

26. The label of claim 22 wherein said laminate cover includes a laminate tamper tab covering said tamper tab and secured thereto by a laminate adhesive.

27. The label of claim 26 including a score line in said laminate cover adjacent said laminate tamper tab whereby, when said laminate cover is pulled away from the remainder of said label, said laminate tamper tab remains with the remainder of said label.

28. The label of claim 22 wherein said tamper tab is exposed.

29. The label of claim 22 wherein said angle is from 110° to 135°.

* * * * *